US010570525B2

(12) United States Patent
Swanson et al.

(10) Patent No.: US 10,570,525 B2
(45) Date of Patent: Feb. 25, 2020

(54) GOLD ELECTROPLATING SOLUTION AND METHOD

(71) Applicant: Hutchinson Technology Incorporated, Hutchinson, MN (US)

(72) Inventors: Kurt C. Swanson, Chippewa Falls, WI (US); Douglas P. Riemer, Waconia, MN (US); Steven A. Fank, Darwin, MN (US)

(73) Assignee: Hutchinson Technology Incorporated, Hutchinson, MN (US)

( * ) Notice: Subject to any disclaimer, the term of this patent is extended or adjusted under 35 U.S.C. 154(b) by 446 days.

(21) Appl. No.: 14/996,412

(22) Filed: Jan. 15, 2016

(65) Prior Publication Data

US 2016/0208401 A1 Jul. 21, 2016

Related U.S. Application Data

(60) Provisional application No. 62/104,280, filed on Jan. 16, 2015.

(51) Int. Cl.

| | |
|---|---|
| ***C25D 3/48*** | (2006.01) |
| ***C25D 5/36*** | (2006.01) |
| ***C25D 7/00*** | (2006.01) |

(52) U.S. Cl.

CPC ..... *C25D 3/48* (2013.01); *C25D 5/36* (2013.01); *C25D 7/00* (2013.01)

(58) Field of Classification Search

CPC ..... C25D 3/48

See application file for complete search history.

(56) References Cited

U.S. PATENT DOCUMENTS

| | | |
|---|---|---|
| 2,149,344 A | 3/1939 | Hull |
| 3,121,053 A | 2/1964 | Hull, Jr. et al. |

(Continued)

FOREIGN PATENT DOCUMENTS

| | | |
|---|---|---|
| CN | 1046145 C | 10/1996 |
| CN | 1133353 A | 10/1996 |

(Continued)

OTHER PUBLICATIONS

Machine translation of JP 2011-099128 of Arai et al. (Year: 2011).*

(Continued)

*Primary Examiner* — Brian W Cohen

(74) *Attorney, Agent, or Firm* — DLA Piper LLP (US)

(57) ABSTRACT

A gold electroplating solution includes a gold (III) cyanide compound, a chloride compound, and hydrochloric acid. The gold (III) cyanide compound is potassium gold (III) cyanide, ammonium gold (III) cyanide, or sodium gold (III) cyanide. The chloride compound is potassium chloride, ammonium chloride, or sodium chloride. Various structures may be made with the gold electroplating solution having a gold layer deposited directly on the stainless steel (SST) layer using a photolithography process. Such structures include a gold pattern having a discontinuous pattern, a bond pad region having one or more traces on the opposite side of the dielectric layer, a gimbal having gold bond pads, and a bonding joint having an electrical interface including a gold layer.

10 Claims, 8 Drawing Sheets

(56) References Cited

U.S. PATENT DOCUMENTS

| | | | | |
|---|---|---|---|---|
| 3,397,127 | A * | 8/1968 | Camp | C25D 3/48 205/266 |
| 3,598,706 | A | 8/1971 | Emiel et al. | |
| 3,929,595 | A * | 12/1975 | Biberbach | C25D 3/48 205/250 |
| 4,168,214 | A * | 9/1979 | Fletcher | C25D 3/48 205/241 |
| 4,470,886 | A | 9/1984 | Duva et al. | |
| 5,202,222 | A * | 4/1993 | Harris | C09D 5/4411 204/488 |
| 6,447,664 | B1 | 9/2002 | Taskovics et al. | |
| 7,832,082 | B1 | 11/2010 | Hentges et al. | |
| 8,048,284 | B2 * | 11/2011 | Reddington | C25D 3/38 106/1.25 |
| 8,405,934 | B2 | 3/2013 | Fuchino | |
| 2002/0115201 | A1 * | 8/2002 | Barenburg | C12N 1/066 435/306.1 |
| 2005/0254175 | A1 * | 11/2005 | Swanson | G11B 5/484 360/245.9 |
| 2006/0163080 | A1 * | 7/2006 | Hayward | C25D 3/60 205/247 |
| 2011/0228425 | A1 | 9/2011 | Liu et al. | |

FOREIGN PATENT DOCUMENTS

| | | | |
|---|---|---|---|
| CN | 1339620 | A | 3/2002 |
| CN | 1940147 | A | 4/2007 |
| CN | 102011154 | A | 4/2011 |
| EP | 0 507 043 | A2 | 10/1992 |
| JP | 63312999 | A | 12/1988 |
| JP | 2011-099128 | A | 5/2011 |
| WO | 2014/083318 | A1 | 6/2014 |

OTHER PUBLICATIONS

International Search Report and Written Opinion issued in PCTUS2016013654, dated Mar. 25, 2016.

International Preliminary Report on Patentabiity in International Application No. PCT/US2016/013654, dated Jul. 27, 2017.

Office Action in Chinese Patent Application No. 201680010994.2, dated Sep. 3, 2018.

Notice of Reasons of Refusal for Japanese Patent Application No. 2017-537505 dated Nov. 26, 2019.

* cited by examiner

GOLD ELECTROPLATING SOLUTION AND METHOD

CROSS-REFERENCE TO RELATED APPLICATION

This application claims priority to Provisional Application No. 62/104,280, filed Jan. 16, 2015, which is herein incorporated by reference in its entirety.

TECHNICAL FIELD

The present invention relates to gold electroplating solutions and methods for electroplating gold. More specifically, the invention relates to gold electroplating solutions and methods for electroplating gold onto a stainless steel surface, with possible patterning of the gold.

BACKGROUND

Gold plating of metal surfaces of electronic devices is often essential for providing reliable, low resistance electrical contact with the metal surfaces. This is particularly true of metal surfaces made of materials that naturally form an oxide passivation layer. Such materials include, for example, stainless steels.

Stainless steel is "stainless" because it forms a generally stable chromium oxide which is impervious to most chemicals. This resistance to chemical attack also makes stainless steel a challenging surface for electroplating gold and achieving good adhesion of the plated gold to the stainless steel surface.

Typically, electroplating of gold to stainless steel uses an acid/chloride solution to plate a relatively thin nickel "strike" layer onto the stainless steel. Gold is then electroplated over the nickel layer, which may also be known as a "tie" layer. This works well, so long as the nickel is completely encapsulated by the gold. However, should any nickel be exposed, for example at an edge of a photoresist defined gold/nickel pattern, then a galvanic reaction will occur when the metals come into contact with conductive solutions in subsequent processing steps, such as commonly used metal cleaning processes. The galvanic reaction corrodes the nickel layer and undercuts the gold layer. Undercutting the gold layer destroys the integrity of the patterned gold/nickel structure.

Thus, for applications requiring a patterned gold structure, it is desirable to plate the gold directly onto the stainless steel surface. What is needed is a photoresist compatible gold plating process that results in good adhesion between the gold layer and the stainless steel surface without introducing a "tie" layers susceptible to corrosion or galvanic dissolution.

Gold (I) cyanide chemistry has also been used for electroplating gold. However, gold(I) cyanide does not perform well at a low pH condition typically used for electroplating solutions for stainless steels. For example, below a pH of 4, the gold (I) cyanide complex starts to disassociate (disproportionation), such that the gold begins to precipitate and the cyanide may be released as a toxic gas. Some forms of gold (III) chloride, such as hydrogen gold (III) tetrachloride ($HAuCl_4$), may be stable below a pH of 4. However, gold (III) chloride plating solutions do not produce an electrodeposited gold layer with good adhesion to stainless steel.

SUMMARY

Various embodiments concern a gold electroplating solution. The gold electroplating solution includes a gold (III) cyanide compound, a chloride compound, and hydrochloric acid. The gold (III) cyanide compound is at least one of potassium gold (III) cyanide, ammonium gold (III) cyanide, and sodium gold (III) cyanide. The chloride compound is at least one of potassium chloride, ammonium chloride, and sodium chloride. In some embodiments, if the gold (III) cyanide compound is potassium gold (III) cyanide, then the chloride compound is potassium chloride; if the gold (III) cyanide compound is ammonium gold (III) cyanide, then the chloride compound is ammonium chloride; and if the gold (III) cyanide compound is sodium gold (III) cyanide, then the chloride compound is sodium chloride. In further embodiments, the gold (III) cyanide compound is potassium gold (III) cyanide and the chloride compound is potassium chloride. In some embodiments, the solution has a pH between about 0 and about 1, or between about 0.7 and about 0.9. In some embodiments, a concentration of the gold (III) cyanide compound is between about 1.0 grams of gold per liter of solution and 3.0 grams of gold per liter of solution, and a concentration of chloride anions is between about 0.30 moles per liter of solution and 0.60 moles per liter of solution. In further embodiments, the concentration of the gold (III) cyanide is between about 1.8 grams of gold per liter of solution and 2.2 grams of gold per liter of solution, and a concentration of chloride anions is between about 0.45 moles per liter of solution and 0.55 moles per liter of solution. In some embodiments, the solution is free of ethylenediamine hydrochloride, and/or oxidizing acids, including nitric acid.

Various embodiments concern methods of producing an electrodeposited gold pattern directly onto a stainless steel surface. Such methods can include creating a photoresist pattern on the stainless steel surface, cleaning portions of the stainless steel surface not covered by the photoresist pattern, immersing the stainless steel surface in a gold electroplating solution, and applying a voltage between an anode within the gold electroplating solution and the stainless steel surface to generate a current from the anode to the stainless steel surface to electroplate gold from the gold electroplating solution onto the stainless steel surface. The gold electroplating solution includes a gold (III) cyanide compound, a chloride compound, and hydrochloric acid. The gold (III) cyanide compound is at least one of potassium gold (III) cyanide, ammonium gold (III) cyanide, and sodium gold (III) cyanide. The chloride compound is at least one of potassium chloride, ammonium chloride, and sodium chloride. If the gold (III) cyanide compound is potassium gold (III) cyanide, then the chloride compound is potassium chloride; if the gold (III) cyanide compound is ammonium gold (III) cyanide, then the chloride compound is ammonium chloride, and if the gold (III) cyanide compound is sodium gold (III) cyanide, then the chloride compound is sodium chloride. In some methods the gold (III) cyanide compound is potassium gold (III) cyanide and the chloride compound is potassium chloride.

Such methods can also include adding sufficient hydrochloric acid to the gold electroplating solution such that the gold electroplating solution has a pH between about 0 and about 1, or such that the gold electroplating solution has a pH between about 0.7 and about 0.9. Such methods can also include maintaining a concentration of potassium gold (III) cyanide in the gold electroplating solution between about 1.0 grams of gold per liter of solution and 3.0 grams of gold per liter of solution, and maintaining a concentration of chloride anions in the gold electroplating solution between about 0.30 moles per liter of solution and 0.60 moles per liter of solution. Such methods can further include maintaining a concentration of potassium gold (III) cyanide in the gold electroplating solution between about 1.8 grams of gold per liter of solution and 2.2 grams of gold per liter of solution, and maintaining a concentration of chloride anions in the gold electroplating solution between about 0.45 moles per liter of solution and 0.55 moles per liter of solution.

In such methods, the voltage generates a continuous direct current, in which the continuous direct current produces a current density at the stainless steel surface of between 1 ampere per square decimeter and 40 amperes per square decimeter. In such methods, the voltage generates a pulsed direct current, and the pulsed direct current may produce a time averaged current density at the stainless steel surface of between 1 ampere per square decimeter and 40 amperes per square decimeter.

Such methods can further include cleaning the stainless steel surface with an oxygen containing plasma cleaning process. The plasma process may be in a partial vacuum, or at atmospheric pressure.

Such methods of producing an electrodeposited gold pattern directly onto a stainless steel surface may be employed for depositing gold on a stainless steel surface of a disk drive head suspension, an optical image stabilization suspension, or a medical device.

While multiple embodiments are disclosed, still other embodiments of the present invention will become apparent to those skilled in the art from the following detailed description, which describes illustrative embodiments of the invention. Accordingly, the detailed description is to be regarded as illustrative in nature and not restrictive.

Figure 1:
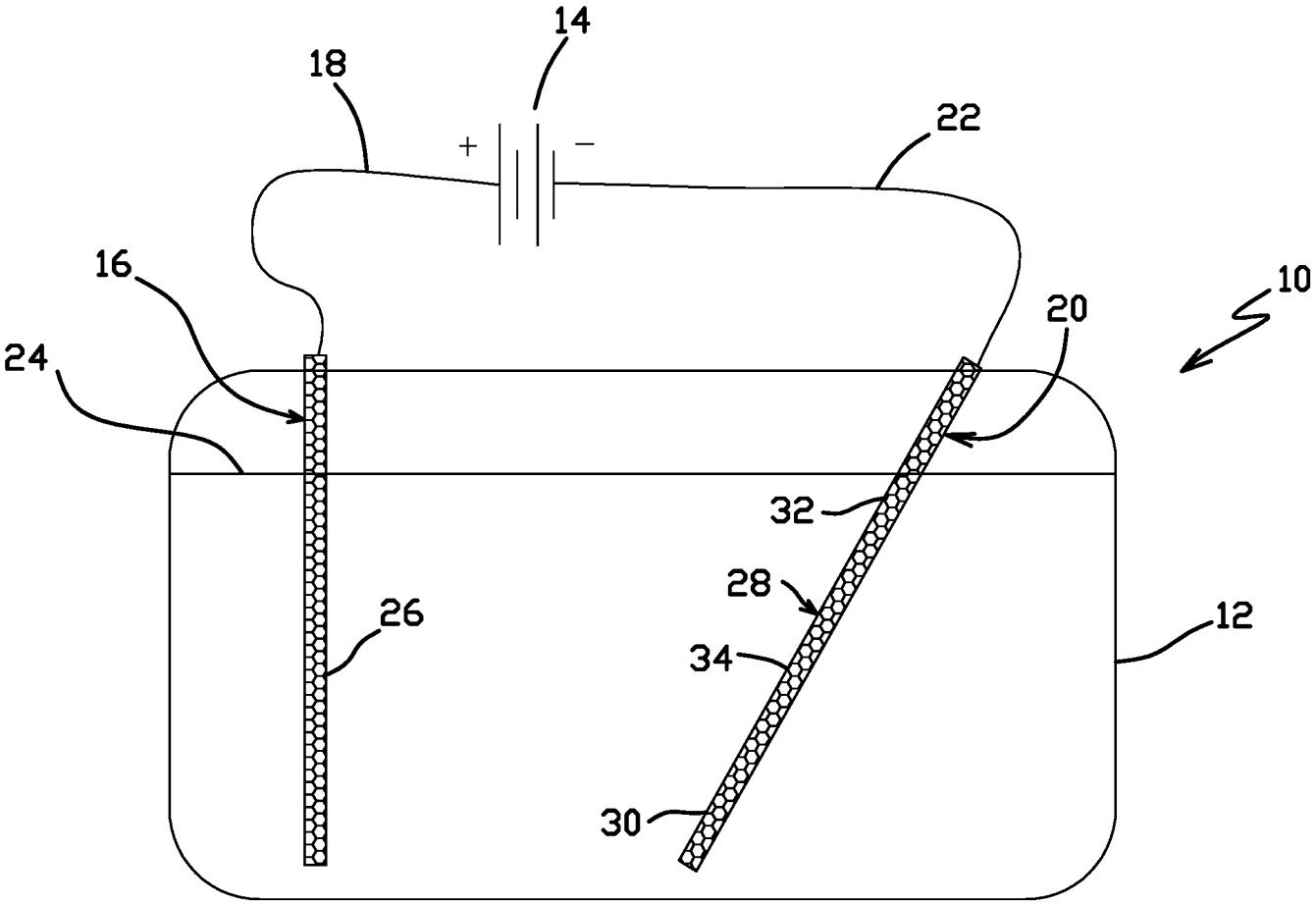
FIG. 1 shows a schematic cross-sectional view of a plating test cell for evaluating electroplating solutions.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments described below enable electroplating a layer of gold directly onto a stainless steel surface. The resulting electroplated gold layer has good adhesion to the stainless steel surface without need for subsequent heat treatment, cladding pressure or other post treatment to gain needed adhesion. Some embodiments are compatible with some commercially available photoresists.

Gold may be electrodeposited directly onto a stainless steel surface by electroplating gold ions from a gold electroplating solution onto a cathodically charged stainless steel surface. For example, a gold electroplating solution may be formed by dissolving gold ions into a suitable electrolyte.

In certain embodiments, the gold ions may be from gold (III) cyanide, such as potassium gold (III) cyanide ($KAu(CN)_4$), ammonium gold (III) cyanide ($NH_4Au(CN)_4$), sodium gold (III) cyanide ($NaAu(CN)_4$), and combinations thereof. Suitable concentrations of the potassium gold (III) cyanide ($KAu(CN)_4$), ammonium gold (III) cyanide ($NH_4Au(CN)_4$), or sodium gold (III) cyanide ($NaAu(CN)_4$) include, but are not limited to, from about 1.0 grams of gold per liter of solution to about 3.0 grams of gold per liter of solution, from about 1.8 grams of gold per liter of solution to about 2.2 grams of gold per liter of solution or about 2 grams of gold per liter of solution of the gold electroplating solution.

The gold electroplating solution may also include one or more acids. A suitable acid for use in the gold electroplating solution includes hydrochloric acid (HCl). The acid may be mixed with water, such as deionized water, to control the pH of the gold electroplating solution.

The gold electroplating solution may have a low, or acidic, pH. For example, the gold electroplating solution may have a pH less than about 1 and greater than 0. More particularly, a suitable pH for the gold electroplating solution may be between about 0.7 and 0.9. In some embodiments, maintaining the gold electroplating solution at a low pH, such as at pH less than about 1, results in electrocleaning a stainless steel surface during the electrodeposition process. This electrocleaning process may eliminate passivation oxide from the stainless steel surface and may produce an electrodeposited gold layer directly on the stainless steel surface with good adhesion.

The gold electroplating solution containing the gold ions may also include potassium chloride (KCl), ammonium chloride ($NH_4Cl$), and/or sodium chloride (NaCl). In some embodiments, the potassium chloride, ammonium chloride, or sodium chloride may be added to the gold electroplating solution to control the concentration of chloride anions with little effect on pH. For example, in some embodiments, the gold electroplating solution may have a concentration of chloride anions between about 0.30 moles per liter of solution and 0.60 moles per liter of solution. More particularly, the gold electroplating solution may have a concentration of chloride anions between about 0.45 moles per liter of solution and 0.55 moles per liter of solution.

In some embodiments, an gold electroplating solution of a gold (III) cyanide, such as potassium gold (III) cyanide ($KAu(CN)_4$), ammonium gold (III) cyanide ($NH_4Au(CN)_4$), or sodium gold (III) cyanide ($NaAu(CN)_4$); a chloride, such as potassium chloride (KCl) or ammonium chloride ($NH_4Cl$); and hydrochloric acid (HCl) produce an electrodeposited gold layer directly onto a stainless steel surface with good adhesion. The gold electroplating solution is compatible with commercial photoresists, and does not produce a build-up on the electroplating anode.

Gold (III) cyanide is stable to a pH approaching 0 due to strong bond strength between the gold (III) and the cyanide. Because of this strong bond strength, gold (III) cyanide has low plating efficiency when compared, for example to gold (I) cyanide. For example, during electrodeposition within a gold electroplating solution containing gold (III) cyanide and having a pH of about 0, only approximately 30% of the reaction occurring at an electroplating surface is gold deposition. The remaining 70% involves other chemical reactions, such as hydrogen reactions with oxides on the surface, which are generally not desirable for high efficiency plating. It has been surprisingly found that in some embodiments at least some of the hydrogen reactions with oxides serve a desirable purpose when electrodepositing onto a stainless steel surface: they electroclean the stainless steel surface and may enable good or improved adhesion of the gold to the stainless steel surface.

In contrast, other forms of gold (III), such as $HAuCl_4$, may be stable at a pH less than 4, but have a bond strength between the gold (III) and the chloride that is insufficient to favor the hydrogen reactions over the gold deposition reaction. Thus, gold (III) chloride plating solutions do not produce an electrodeposited gold layer with good adhesion to stainless steel.

In some embodiments, the gold electroplating solution may be suitable for use with surfaces, such as stainless steel surfaces, that have a photoresist or other desired organic material. For example, in some embodiments, the gold electroplating solution may be free of oxidizing acids, such as nitric acid, sulfuric acid, nitrate salts or other components which may be, or which may combine, to be corrosive to organic material.

In some embodiments, the gold electroplating solution may be free of ethylenediamine hydrochloride. In some embodiments, ethylenediamine hydrochloride may be used to enhance electrical conductivity and provide the chloride ions. However, it has been found that in some embodiments, ethylenediamine can polymerize on the electroplating anode, rendering it ineffective.

In some embodiments, producing an electrodeposited gold pattern directly onto a stainless steel surface may begin with producing a photoresist pattern on the stainless steel surface of a substrate. The photoresist pattern may be produced using, for example, a negative-acting dry film photoresist. Such photoresists may be developed using an aqueous solution. After developing and optionally baking the photoresist pattern, the portion of the stainless steel surface not covered by photoresist may optionally be cleaned to remove residual organics from the portions of the stainless steel surface where gold is to be electroplated. That is, the stainless steel surface may be cleaned to remove residual organics from the portions of the stainless steel surface that are or are intended to be exposed. Cleaning to remove residual organics may be done, for example, by exposing the stainless steel surface to a brief oxygen plasma cleaning process, such as an atmospheric plasma clean or a corona clean. The oxygen plasma cleaning process may be implemented as either an inline process (e.g., continuous reel-to-reel process) or an off-line process (e.g., a panel, or piece-part process).

In some embodiments, an optional wet cleaning process may follow the plasma cleaning process. In the wet cleaning process, the stainless steel surface may be immersed in a wet cleaning solution prior to immersion in the gold electroplating solution to increase the surface energy of the stainless steel surface and promote wetting in the gold electroplating solution. The wet cleaning solution may include one or more non-oxidizing mineral or organic acids. In some embodiments, the wet cleaning solution may include hydrochloric acid or citric acid.

Following the cleaning process, one or more substrates having patterned stainless steel surfaces may be immersed in the gold electroplating solution. One or more anodes may also be immersed in the gold electroplating solution and a voltage may be applied between the anode(s) and the stainless steel surface(s) to generate a current from the anode(s) to the stainless steel surfaces(s) to electroplate gold from the gold electroplating solution onto the stainless steel surface(s).

In some embodiments, the current is a continuous direct current generated between the electrodes. In other embodiments, the form of the current may be pulsed direct current (also known as chopped direct current). In pulsed direct current, the direct current is cycled between on and off. The period of time that the current is on in an on/off cycle may be different from the period of time that the current is off in the cycle. The period of time that the current is on may range from 5% of a cycle to 50% of a cycle. The frequency of on/off cycles may be from 5 Hz to 200 Hz. The current may be cycled on and off many times to deposit gold to a desired thickness.

In some embodiments, the continuous direct current generated may have a current density at the stainless steel surface(s) of between 1 ampere per square decimeter (ASD) and 40 ASD. In other embodiments, the current density at the stainless steel surface(s) may be about 4 ASD.

In some embodiments, in which the current is a pulsed direct current, the current density is a time averaged current density at the stainless steel surface(s) of between 1 ASD and 40 ASD. In other embodiments, the time averaged current density at the stainless steel surface(S) may be about 4 ASD.

As described herein, electrocleaning of the stainless steel may occur during the electroplating process. For example, in some embodiments in which electroplating occurs at a pH of 1 or less, water disassociating at the cathodically (negatively) charged stainless steel surface creates hydrogen cations. These hydrogen cations, and/or hydrogen cations supplied by the acid content, then form hydrogen reactive neutrals which combine with the oxygen from the surface iron, nickel, and chromium oxides. The chlorides in the gold electroplating solution then may complex with the now loosely attached iron, nickel and chromium, which then get "re-electroplated" to the stainless steel surface as a metal without the oxide. Thus, in some embodiments, in addition to removing the oxide passivation layer from the surface of the stainless steel, the electrodeposition process may also keep the metals contamination levels low.

In some embodiments, the gold electroplated directly onto stainless steel has good adhesion. The adhesion may be verified by any suitable method known in the art, such as a tape test, scratch test, bend test, peel test or any other pull or shear test. A more quantifiable scratch test may be conducted by forming lines and spaces by electroplating gold to a thickness of at least 3 microns, and then running a razor blade across a group of 20 micron lines and spaces. Electroplated gold having unsuitable or bad adhesion to the stainless steel surface will peel away from the stainless steel surface. For example, the gold layer will peel away from the stainless steel surface should any voids exist between the gold and the stainless steel. Further verification of void free plating (i.e, of good or suitable adhesion) may be provided by observation of the interface between gold and stainless steel by focused ion beam.

In some embodiments, the chloride, such as potassium chloride (KCl) or ammonium chloride ($NH_4Cl$), may add chloride ions, in addition to those supplied by the hydrochloric acid (HCl), for complexing the free iron, nickel, and chromium, as described herein. By adjusting the potassium chloride (KCl) or ammonium chloride ($NH_4Cl$), the total chloride concentration can be adjusted independently of the pH, which is adjusted by the hydrochloric acid (HCl).

Additionally or alternatively, the potassium chloride (KCl), ammonium chloride ($NH_4Cl$), or sodium chloride (NaCl) in combination with the acid, such as hydrochloric acid (HCl), may provide a pH buffer system and may reduce or eliminate the risk of the pH of the gold electroplating solution changing during the electroplating process.

EXAMPLES

The present invention is more particularly described in the following examples that are intended as illustration only, since numerous modifications and variations within the scope of the present invention will be apparent to those skilled in the art.

Electroplating Test

FIG. 1 shows a schematic cross-sectional view of an electroplating test cell used for evaluating electroplating solutions and electroplating process conditions. This type of test cell is also known as a Hull cell and described, for example in U.S. Pat. Nos. 2,149,344 and 3,121,053. The Hull cell is designed such that a wide range of current densities are exhibited in a single electroplating test. This permits, for example, determining the sensitivity of electroplating process quality to variations in current density. In addition, by varying the concentration of a component of an electroplating solution component of interest in successive electroplating test runs, the sensitivity of plating process quality to component concentration may also be determined.

FIG. 1 shows electroplating test cell 10 including plating tank 12, power source 14, anode 16, anode cable 18, cathode 20, cathode cable 22, and gold electroplating solution 24. Plating tank 12 was constructed at least partially of electrically isolating materials such that any voltage potential within plating tank 12 was not short circuited through plating tank 12. Power source 14 was a direct current power source. Anode 16 was a plate-shaped electrode made of materials that are at least largely chemically inert with respect to gold electroplating solution 24, for example, iridium and titanium. Anode cable 18 and cathode cable 22 were electrical cables capable of carrying electrical current at levels sufficient for efficient electroplating. Cathode 20 was a plate-shaped electrode made of stainless steel.

As shown in FIG. 1, gold electroplating solution 24 filled at least a portion of plating tank 12. Anode cable 18 electrically connected a positive terminal of power source 14 to anode 16. Cathode cable 22 electrically connected a negative terminal of power source 14 to cathode 20. Anode 16 included anode surface 26. Anode surface 26 was a surface of anode 16 immersed within gold electroplating solution 24 and facing cathode 20. Cathode 20 included cathode surface 28. Cathode surface 28 was a surface of cathode 20 immersed within gold electroplating solution 24 and facing anode 16. Cathode surface 28 included proximal portion 30, distal portion 32, and intermediate portion 34 between proximal portion 30 and distal portion 32. As shown in FIG. 1, cathode 20 was disposed relative to anode 16 such that a distance between proximal portion 30 and anode surface 26 is less than a distance between distal portion 32 and anode surface 26. As a result of this configuration between anode surface 26 and cathode surface 28, current density varied along cathode surface 28 by a factor of about 40, with highest current densities occurring at proximal portion 30, lowest current densities occurring at distal portion 32, and intermediate current densities occurring at intermediate portion 34.

During each electroplating test, an electrical current flowed from the positive terminal of power source 14, through anode cable 18 to anode 16. The current the flowed from anode surface 26, through gold electroplating solution 24, to cathode surface 28 of cathode 20. Water in gold electroplating solution 24 disassociated at cathode surface 28 creating hydrogen cations and hydrogen reactive neutrals which aggressively combined with the oxygen from iron, nickel, and chromium oxides on cathode surface 28. The high level of chlorides in the gold electroplating solution 24 then complexed with the now loosely attached iron, nickel and chromium, which were then "re-electroplated" to the stainless steel of cathode surface 28 as a metal without the oxide. Once the oxide passivation layer from cathode surface 28 was removed, gold from the gold (III) cyanide in gold electroplating solution 24 plated onto to cathode surface 28. From cathode 20, the current flow returned to the negative terminal of power source 14 through cathode cable 22.

Examples 1-3

The electoplating test described above was employed in electroplating examples of varying chloride concentrations, as shown in the TABLE below. In each example, the current density across the cathode surface ranged between a high of 40 amps per square decimeter (ASD) at the proximal portion to a low of 1 ASD at the distal portion, with a nominal 3.8 ASD within the intermediate portion. In each example, the gold electroplating solution consisted of an aqueous solution of potassium gold (III) cyanide ($KAu(CN)_4$), potassium chloride (KCl), and hydrochloric acid (HCl). $KAu(CN)_4$ was maintained at a concentration of 2.0 g of gold per liter of solution (or about 3.5 g of $KAu(CN)_4$ per liter of solution). HCl concentration was maintained at 0.31 M, keeping the pH of the gold electroplating solution below 1. Plating time was for 60 seconds at a temperature of 23 C.

In each example, the chloride concentration was varied by varying the concentration of KCl. The chloride concentration was reduced to examine changes in conductivity of the gold electroplating solution, as indicated by a measured electrical potential between the anode and the cathode (inter-electrode potential). The examples and results are summarized in the TABLE below.

TABLE

| Example | Potassium Chloride (M) | Total Chlorides (M) | Inter-Electrode Potential (V) |
|---|---|---|---|
| 1 | 0.09 | 0.40 | 3.9 |
| 2 | 0.18 | 0.49 | 3.7 |
| 3 | 0.25 | 0.56 | 3.6 |

As shown in the TABLE, variations in chloride concentration for the embodiments described had a small, but measurable change in bath conductivity, as indicated by the inter-electrode potential. In all three examples, visual inspection of the electroplated gold on the stainless steel cathode surface showed it to be smooth, shiny, and well-adhered based on scratch tests described below. This was the case across the range of current densities tested, 1 ASD to 40 ASD. Thus, as shown in the examples of the TABLE, embodiments are robust, producing good results across a wide range of conditions.

Example Structures

Direct electroplating of a gold layer directly onto an SST layer facilitates the development of advantageous gold patterns that may be used in hard disk drive suspensions. Example advantageous applications described herein are related to hard disk drive suspensions. However, the disclosure recognizes that one having skill in the art and the benefit of this disclosure may utilize the gold electroplating solution to electroplate gold directly onto SST in a variety of other suitable applications as well, for example, optical image stabilization suspension devices (such as, e.g., those of the type disclosed in PCT International Publication No. WO 2014/083318) and insertable or implantable medical devices (such as, e.g., catheters, pacemakers, defibrillators, leads and electrodes).

Figure 2:
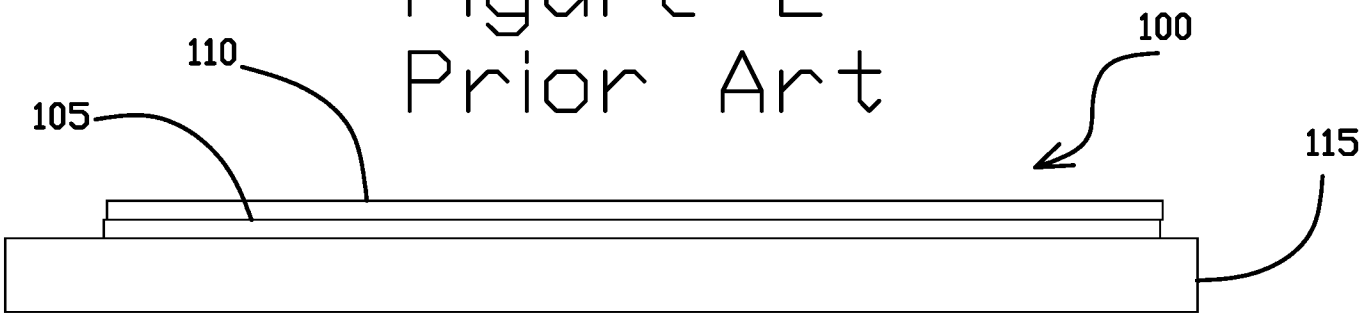
Figure 2 Prior Art
FIGS. 2-3 are schematic illustrations of a layered structure including a layer of nickel between a layer of gold and a stainless steel (SST) layer.
Figure 3:
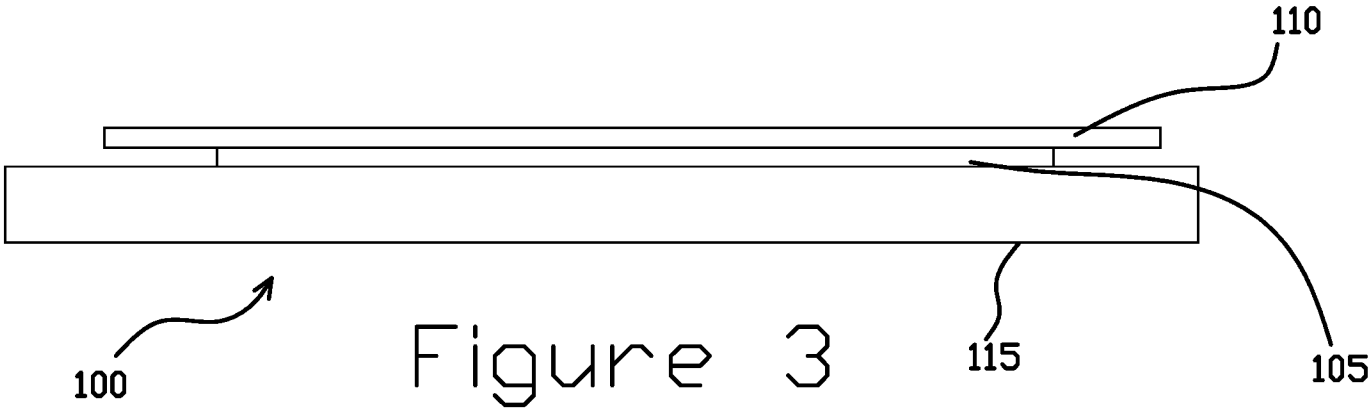
Figure 3 Prior Art

FIGS. 2-3 are schematic illustrations of a layered structure 100 including a layer of a nickel layer 105 between a layer of gold 110 and a stainless steel (SST) layer 115, according to some embodiments in the art. FIG. 2 shows the layered structure 100 just after the gold layer 110 is plated onto the layer of nickel 105. FIG. 3 shows the layered structure 100 with the nickel layer 105 corroded away, for example, by a galvanic reaction facilitated by a metal cleaning process. As can be seen, edges of the gold layer 110 are unsupported, also known as gold flash, where the nickel layer 105 has been undercut by corrosion. Portions of the gold layer 110 are more susceptible to flaking off and causing a defect.

In contrast, the gold electroplating solution facilitates electroplating the gold layer 110 directly onto the SST layer 115 without the nickel layer 105 with the gold layer 110 being patterned by a photoresist. The gold layer 110 is directly supported by the SST layer 115, even after a metal cleaning process, which improves the edge quality and reduces the potential for flaking relative to the use of an intervening nickel layer 105. The electrodeposited and patterned gold layer 110 may be used in a variety of applications, including hard disk drive components.

Figure 4:
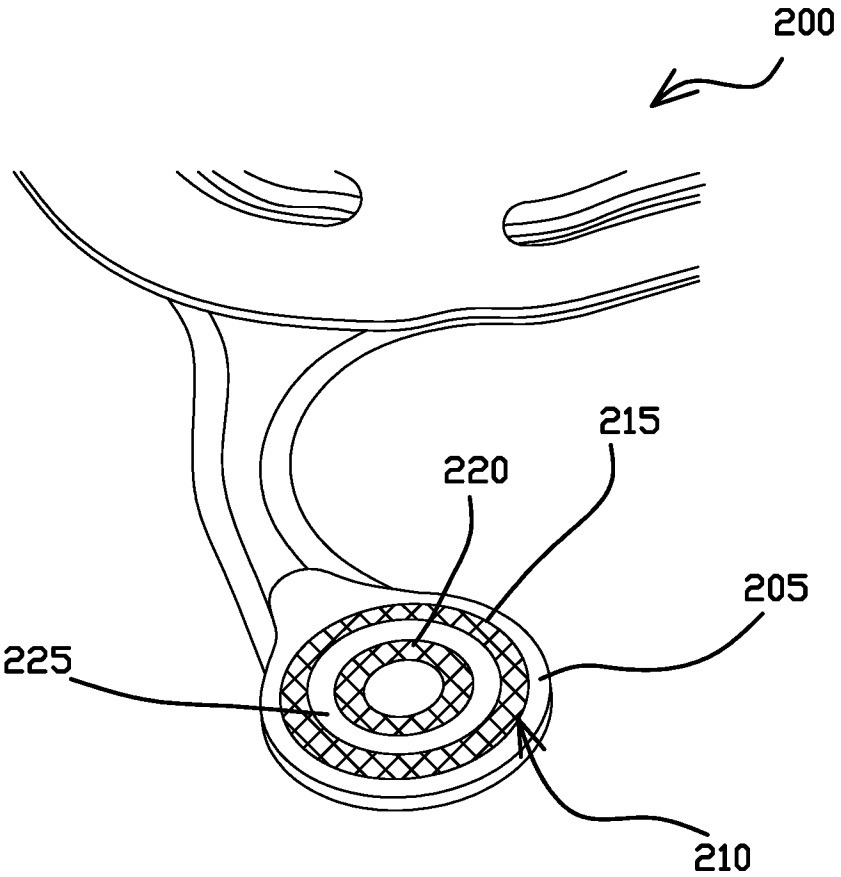
FIG. 4 is a perspective view of a portion of a hard disk drive suspension component having a gold pattern, according to some embodiments.

FIG. 4 is a perspective view of a portion of a hard disk drive suspension component 200 having a gold pattern 210, according to some embodiments. The component 200 includes an SST pad 205 and a gold pattern 210 electrodeposited directly onto the SST pad 205. A gold electrodeposition process with a photoresist is capable of producing a gold pattern 210 on the SST pad 205 that is discontinuous. In other words, the gold pattern may comprise unconnected, independent shapes. The gold pattern 210 may be wholly separated by spaces or gaps without gold, leaving the SST pad 205 exposed. In the illustrated embodiment, the gold pattern 210 comprises a first concentric ring 215 and a second concentric ring 220 interior to the first concentric ring. The gold pattern 210 further includes a gap 225 separating the concentric rings 215, 220 leaving a portion of the SST pad 205 exposed. As shown, the gap 225 may completely separate the concentric rings 215, 220 when desired. Though the gold pattern 210 contains several edges, the gold pattern is less susceptible to flaking than if a nickel layer were deposited between the gold and the SST.

Figure 5:
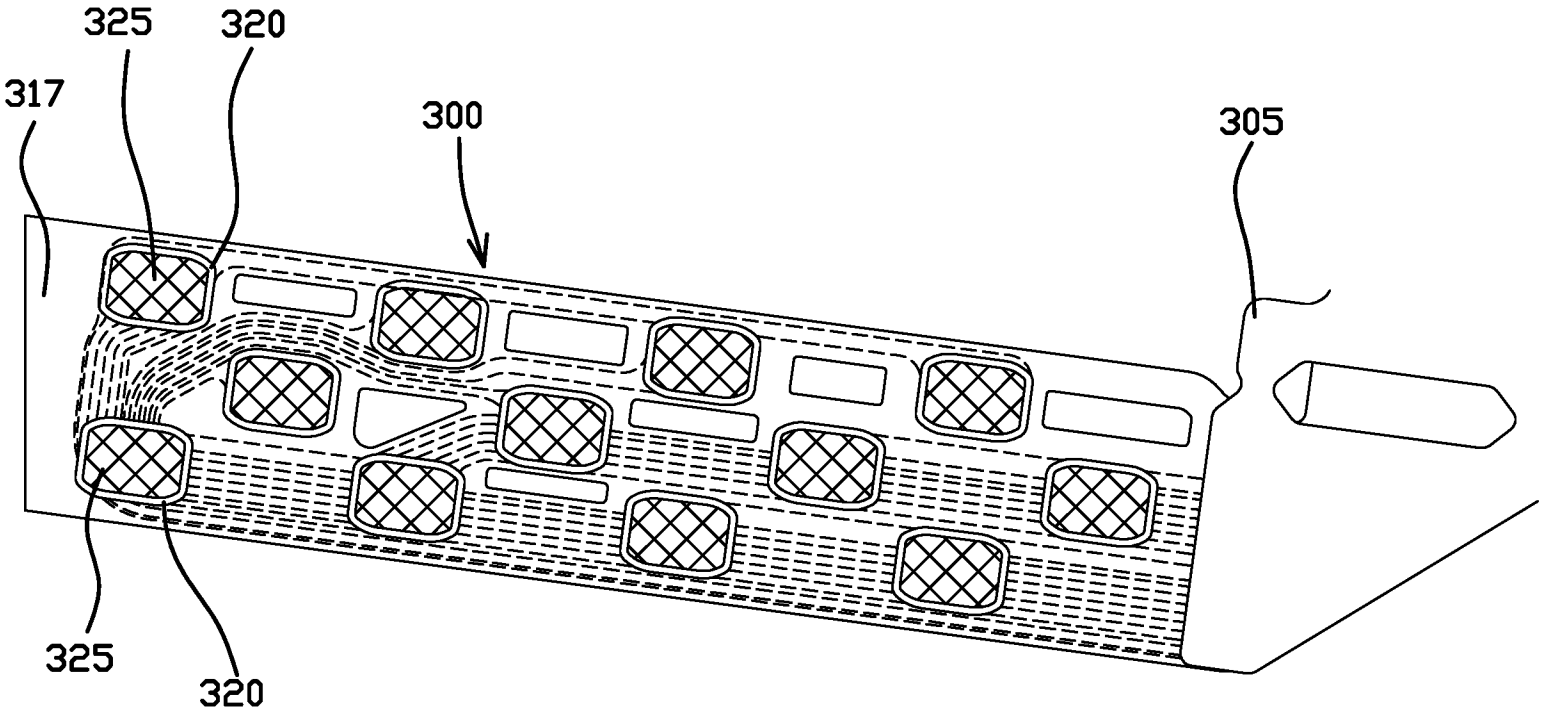
FIGS. 5-6 are top and bottom side views, respectively, of a suspension flexure tail having an SST side with an SST layer and a trace side with a trace layer and a gold pattern electrodeposited on SST, according to some embodiments.
Figure 6:
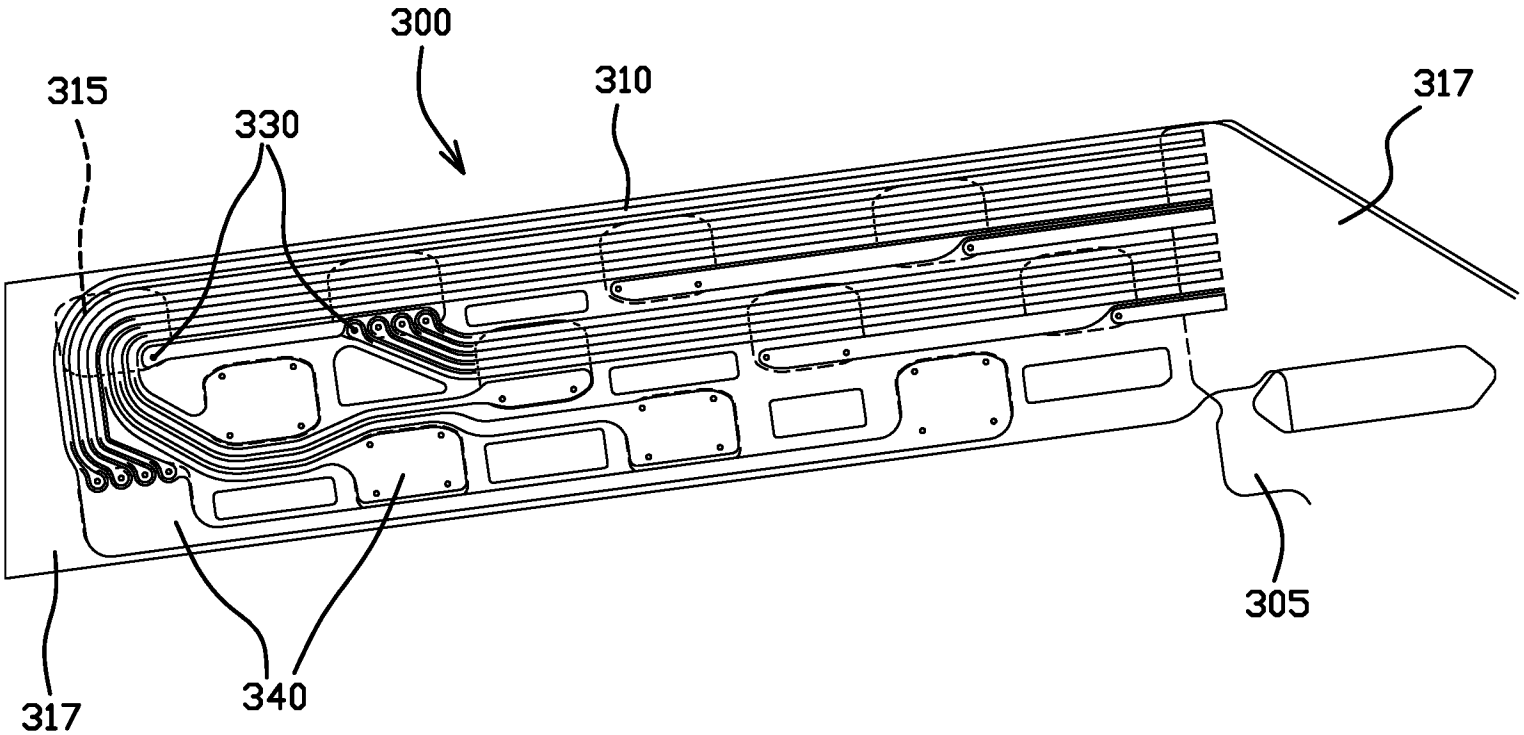

FIGS. 5 and 6 are top and bottom side views, respectively, of a suspension flexure tail 300 having an SST side with an SST layer 305 and a trace side with a trace layer 310 and a gold pattern electrodeposited on SST, according to some embodiments. A dielectric layer 317 typically separates the SST layer 305 and the trace layer 310. The tail 300 may be electrically coupled to another circuit at one or more bonding areas using anisotropic conductive film (ACF) to form one or more connections. This type of bonding typically utilizes an SST pad backing for structural support during bonding to a copper bond pad. The capability to directly electroplate a gold pattern on the SST pad allows the SST pad to be used as an electrically bonded pad in addition to being structural support.

Perhaps as best seen in FIG. 5, the tail 300 includes an SST layer 305 having one or more SST pads 320. In certain embodiments, the SST pads 320 are each electrically isolated from the rest of the SST layer 305 and from other SST pads. One or more of the SST pads 320 has a corresponding gold bond pad 325. In certain embodiments, a gold bond pad 325 is deposited directly onto an SST pad 320 through an electrodeposition process with a photoresist. The gold bond pad 325 provides an enhanced electrical coupling interface relative to the bare SST pad 320. As a result of the improved electrical properties, the gold bond pads 325 on the SST pads 320 can be used as bonding terminals on the tail 300. In some embodiments, all SST pads 320 have a corresponding gold bond pad 325. In other embodiments (not shown), less than all SST pads have a corresponding gold bond pad.

Turning to FIG. 6, the tail 300 includes a trace layer 310 including a plurality of traces extending along the tail, some of which are electrically isolated from each other. The one or more traces, or portions of the trace layer 310, include a first end near a proximal side of the tail and extend distally along the tail to a second end or termination point. In some embodiments, one or more traces terminate at one or more copper bond pads 340. In further embodiments, one or more traces terminate at one or more vias 330. Each via 330 couples a trace to an SST pad 320 or portion of the SST layer 305. One or more vias 330 may be coupled to a copper bond pad 340.

As shown in the illustrated embodiment, one or more SST pads 320 have a corresponding copper bond pad 340 and one or more corresponding vias 330, which electrically couples the SST pad 320 with the corresponding copper bond pad 340. The SST pad 320 facilitates the bonding of the corresponding copper bond pad 340 during ACF bonding to the trace side of the tail 300.

Also, as shown, one or more SST pads 320 do not have a corresponding copper bond pad 340 but have a trace portion 315. For such SST pads 320 having a gold bond pad 325, however, the ACF film may be deposited onto the gold bond pad 325 for ACF bonding to the SST side of the tail 300. This structure including gold bond pads 325 on SST pads 320 allows for ACF bonding to both sides of the tail 300 without an additional process of introducing copper to the SST side of the tail 300. Furthermore, with the absence of a copper bond pad 340, this structure enables more space for the traces of the trace layer 310 to extend along the tail 300 and thus higher densities of traces and bonding areas per tail 300.

Figure 7:
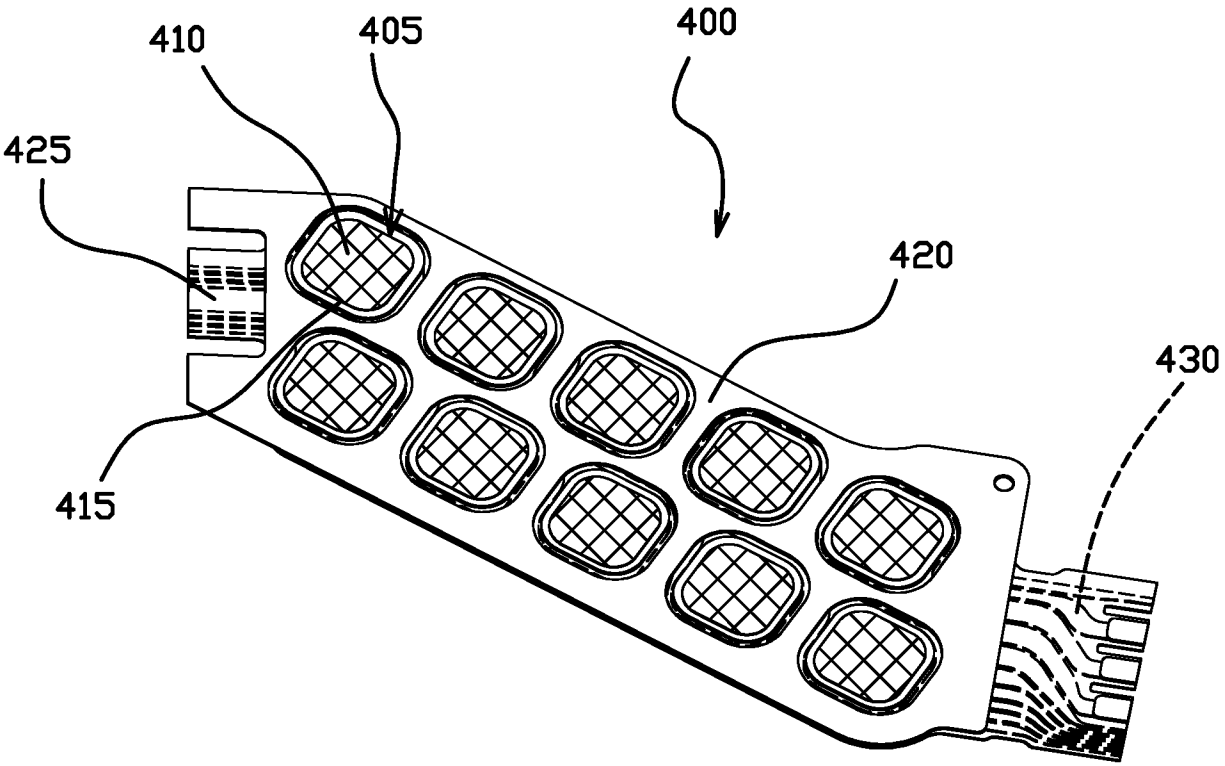
FIGS. 7 and 8 are perspective views of a portion of a flexure tail including a plurality of dynamic electric test (DET) pads having a gold pattern electrodeposited on SST, according to some embodiments.
Figure 8:
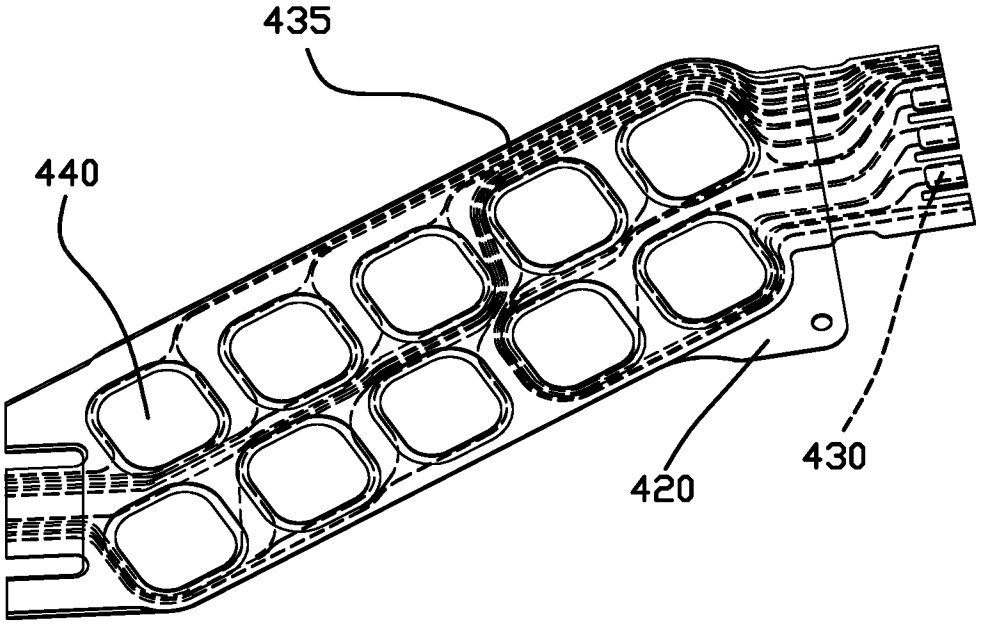

FIGS. 7 and 8 are perspective views of a portion of a flexure tail 400 including a plurality of dynamic electric test (DET) pads 405 having a gold pattern electrodeposited on SST, according to some embodiments. The DET pads 405 enable test probing from the SST side of the tail 400. In certain embodiments, one or more of DET pads 405 include a gold pad 410 deposited directly on an SST pad 415. The SST pad 415 may also be considered part of an SST layer 420. The SST layer 420 is disposed on one side of a dielectric layer 425. Disposed on the other side of the dielectric layer 425 is a trace layer 430. The trace layer 430 is exposed through openings in a cover layer 435 disposed on the trace layer 430. One more copper bond pads 440, for example, may be exposed through the cover layer 435. When the suspension is assembled, the flexure tail 400 may be electrically coupled to other portions of the assembly via copper bond pads 440. One or more copper bond pads 440 may be electrically coupled to a corresponding DET pad 405 through a via (not shown) in the dielectric layer 425. This structure may be more easily manufactured than structures including copper DET pads that fully extend through the dielectric layer, because a backside access step would not be necessary.

Figure 9:
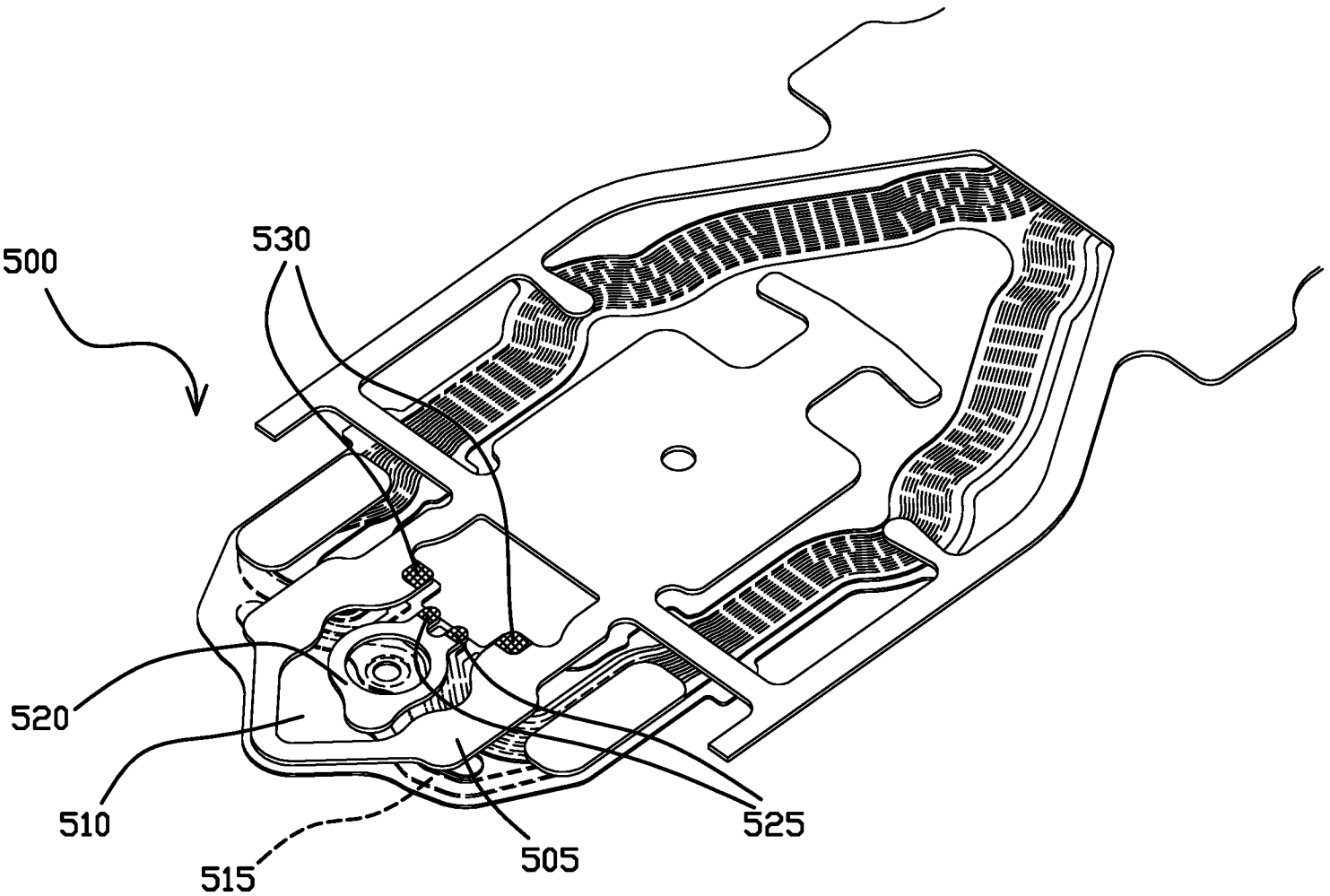
FIG. 9 is a perspective view of a gimbal having a gold pattern electrodeposited on SST, according to some embodiments.

FIG. 9 is a perspective view of a gimbal 500 having a gold pattern electrodeposited on SST, according to some embodiments. As shown, the gimbal 500 is structured to receive a laser diode as part of a heat-assisted magnetic recording (HAMR) gimbal. The illustrated gimbal 500 includes an SST layer 505 disposed on a dielectric layer 510, which is at least partially backed by a trace layer 515. The SST layer 505 includes an SST island 520, which is electrically isolated from other portions of the SST layer 505. A first set of one or more gold bond pads 525 may be directly deposited on the SST island 520. A second set of one or more gold bond pads 530 may be directly disposed on another portion of the SST layer 505. The first and second sets of gold bond pads 525, 530 together provide two electrical terminals for a laser diode. This structure may be manufactured more easily than a structure utilizing copper pads, as discussed herein with respect to other embodiments.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

The invention claimed is:

1. A method of producing an electrodeposited gold pattern directly onto a stainless steel surface, the method comprising:

creating a photoresist pattern on the stainless steel surface;

cleaning portions of the stainless steel surface not covered by the photoresist pattern;

immersing the stainless steel surface in a gold electroplating solution, wherein the gold electroplating solution includes:

a gold (III) cyanide compound, wherein the gold (III) cyanide compound consists of ammonium gold (III) cyanide;

a chloride salt, the chloride salt consists of ammonium chloride;

hydrochloric acid, wherein the hydrochloric acid is supplied in a sufficient amount such that the gold electroplating solution has a pH between about 0 and about 1, and wherein the gold electroplating solution is free of oxidizing acids and nitrate salts; and applying a voltage between an anode within the gold electroplating solution and the stainless steel surface to generate a current from the anode to the stainless steel surface to electroplate gold from the gold electroplating solution onto the stainless steel surface.

2. The method of claim 1, further comprising adding sufficient hydrochloric acid to the gold electroplating solution such that the gold electroplating solution has a pH between about 0.7 and about 0.9.

3. The method of claim 1, further comprising maintaining a concentration of ammonium gold (III) cyanide in the gold electroplating solution between about 1.0 grams of gold per liter of solution and 3.0 grams of gold per liter of solution, and maintaining a concentration of chloride anions in the gold electroplating solution between about 0.30 moles per liter of solution and 0.60 moles per liter of solution.

4. The method of claim 3, further comprising maintaining a concentration of ammonium gold (III) cyanide in the gold electroplating solution between about 1.8 grams of gold per liter of solution and 2.2 grams of gold per liter of solution, and maintaining a concentration of chloride anions in the gold electroplating solution between about 0.45 moles per liter of solution and 0.55 moles per liter of solution.

5. The method of claim 1, wherein cleaning the stainless steel surface includes an oxygen plasma cleaning process.

6. The method of claim 1, wherein the voltage generates a continuous direct current, and wherein the continuous direct current produces a current density at the stainless steel surface of between 1 ampere per square decimeter and 40 amperes per square decimeter.

7. The method of claim 1, wherein the voltage generates a pulsed direct current.

8. The method of claim 7, where the pulsed direct current produces a time averaged current density at the stainless steel surface of between 1 ampere per square decimeter and 40 amperes per square decimeter.

9. The method of claim 1, wherein the stainless steel surface is one selected from the group consisting of a disk drive head suspension, an optical image stabilization suspension, and a medical device.

10. The method of claim 1, wherein the gold electroplating solution is free of ethylenediamine hydrochloride.

* * * * *